US008353370B2

(12) United States Patent
Bellin et al.

(10) Patent No.: US 8,353,370 B2
(45) Date of Patent: Jan. 15, 2013

(54) POLYCRYSTALLINE DIAMOND CUTTING ELEMENT STRUCTURE

(75) Inventors: Federico Bellin, Orem, UT (US); Yi Fang, Provo, UT (US); Michael Stewart, Provo, UT (US); Nephi M. Mourik, Provo, UT (US); Peter Thomas Cariveau, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/963,088

(22) Filed: Dec. 8, 2010

(65) Prior Publication Data

US 2011/0132668 A1 Jun. 9, 2011

Related U.S. Application Data

(60) Provisional application No. 61/267,584, filed on Dec. 8, 2009.

(51) Int. Cl.
*E21B 10/36* (2006.01)

(52) U.S. Cl. ..... 175/431; 175/432; 175/428

(58) Field of Classification Search ..... 175/425, 175/428, 430, 431, 434
See application file for complete search history.

(56) References Cited

U.S. PATENT DOCUMENTS

| | | | | |
|---|---|---|---|---|
| 5,379,854 | A | 1/1995 | Dennis | |
| 5,469,927 | A | 11/1995 | Griffin | |
| 6,041,875 | A * | 3/2000 | Rai et al. | 175/432 |
| 6,244,365 | B1 | 6/2001 | Southland | |
| 6,260,639 | B1 * | 7/2001 | Yong et al. | 175/431 |
| 6,290,008 | B1 | 9/2001 | Portwood et al. | |
| 6,460,636 | B1 | 10/2002 | Yong et al. | |
| 6,460,637 | B1 | 10/2002 | Siracki et al. | |
| 6,488,106 | B1 | 12/2002 | Dourfaye | |
| 6,513,608 | B2 | 2/2003 | Eyre et al. | |
| 6,962,218 | B2 | 11/2005 | Eyre | |
| 7,270,199 | B2 | 9/2007 | Hall et al. | |
| 7,287,610 | B2 | 10/2007 | Svendsen et al. | |
| 7,407,012 | B2 | 8/2008 | Keshavan et al. | |
| 2008/0302578 | A1 | 12/2008 | Eyre et al. | |

OTHER PUBLICATIONS

International Search Report with Written Opinion issued in corresponding International Application No. PCT/US2010/059408 dated Jun. 21, 2011 (8 pages).

* cited by examiner

*Primary Examiner* — Kenneth L Thompson
*Assistant Examiner* — Yong-Suk (Philip) Ro
(74) *Attorney, Agent, or Firm* — Osha Liang LLP

(57) ABSTRACT

A cutting element includes a substrate having an interface surface; and an ultrahard material layer disposed on the interface surface. An interface surface includes a plurality of surface features, wherein at least one of the plurality of surface features intersects a neighboring surface feature at a height that is intermediate an extremity of the at least one of the plurality of surface features and a base of the at least one of the plurality of surface features.

32 Claims, 16 Drawing Sheets

POLYCRYSTALLINE DIAMOND CUTTING ELEMENT STRUCTURE

BACKGROUND OF INVENTION

1. Field of the Invention

Embodiments disclosed herein generally relate to a cutting element. Specifically, embodiments disclosed herein relate to a non-uniform interface for a cutting element.

2. Background Art

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings, and cool the invention.

The present invention is described in terms of cutter elements for roller cone drill bits, although its benefits can be realized in percussion bits as well as other fixed cutter bits. Referring to FIG. 1A, in a typical roller cone drill bit 150, the bit body 151 supports three roller cones 153 that are rotatably mounted on cantilevered journals (not shown), as is well known in the art. Each roller cone in turn supports a plurality of cutting elements 159, which cut and/or crush the wall or floor of the borehole and thus advance the bit.

Referring now to FIG. 1B, conventional cutting inserts 166 typically have a body 168 consisting of a cylindrical grip portion from which a convex cutting end 170 extends. In order to improve their operational life, these inserts are sometimes coated with a superhard, sometimes also known as an ultrahard, material. The coated cutting layer typically comprises a superhard substance, such as a layer of polycrystalline diamond (PCD). The substrate, which supports the cutting layer is normally formed of a hard material such as tungsten carbide (WC). The grip is embedded in and affixed to the roller cone and the cutting end extends outwardly from the surface of the roller cone. The protrusion, for example, may be hemispherical, which is commonly referred to as a semi-round top (SRT), or may be conical, or chisel-shaped, or may form a crest that is inclined relative to the plane of intersection between the grip and the cutting end.

Although cutting elements having various shapes have significantly expanded the scope of formations for which drilling with diamond bits is economically viable, the interface 172 between the substrate and the diamond layer continues to limit usage of these cutter elements, as it is prone to failure. Specifically, it is not uncommon for diamond coated inserts to fail during cutting. Failure typically takes one of three common forms, namely spalling/chipping, delamination, and wear. External loads due to contact tend to cause failures such as fracture, spalling, and chipping of the diamond layer. The impact mechanism involves the sudden propagation of a surface crack or internal flaw initiated on the PCD layer, into the material below the PCD layer until the crack length is sufficient for spalling, chipping, or catastrophic failure of the enhanced insert. On the other hand, internal stresses, for example, thermal residual stresses resulting from manufacturing processes, tend to cause delamination of the diamond layer, either by cracks initiating along the interface and propagating outward, or by cracks initiating in the diamond layer surface and propagating catastrophically along the interface.

Excessively high contact stress and high temperature, along with a very hostile downhole operation environment, are known to cause severe wear to the diamond layer of cutting elements in roller cone drill bits. The wear mechanism occurs due to the sliding of the PCD relative to the earth formation.

It has been found that chipping, spalling, and delamination are common failure modes for cutting elements having ultrahard surfaces. Accordingly, there exists a need for a more durable cutting element which may reduce the occurrence of spalling and/or delamination.

SUMMARY OF INVENTION

In one aspect, embodiments disclosed herein relate to a cutting element that includes a substrate having an interface surface; an ultrahard material layer disposed on the interface surface; and the interface surface comprising a plurality of surface features, wherein at least one of the plurality of surface features intersects a neighboring surface feature at a height that is intermediate an extremity of the at least one of the plurality of surface features and a base of the at least one of the plurality of surface features.

In another aspect, embodiments disclosed herein relate to a cutting element that includes a substrate having a cylindrical grip region, a substantially convex cutting end extending from the cylindrical grip region, and a longitudinal axis of the cylindrical grip region extending through the cylindrical grip region and the substantially convex cutting end; and an ultrahard material layer disposed on the substantially convex cutting element; wherein the surface of the substantially convex cutting end of the substrate comprises a plurality of surface features, wherein at least one of the plurality of surface features intersects a neighboring surface feature such that a radius from the longitudinal axis at an upper end of the cylindrical grip region to the intersection of the at least one of the plurality of surface features with the neighboring surface feature is not equal to a radius to a base of the at least one of the plurality of surface features.

Other aspects and advantages of the invention will be apparent from the following description and the appended claims.

DETAILED DESCRIPTION

In one aspect, embodiments disclosed herein relate to a cutting element for use on a drill bit to drill wellbores through earth formation. More specifically, embodiments disclosed herein relate to a cutting element having a non-uniform interface surface between a substrate and an ultrahard material layer.

Figure 1A:
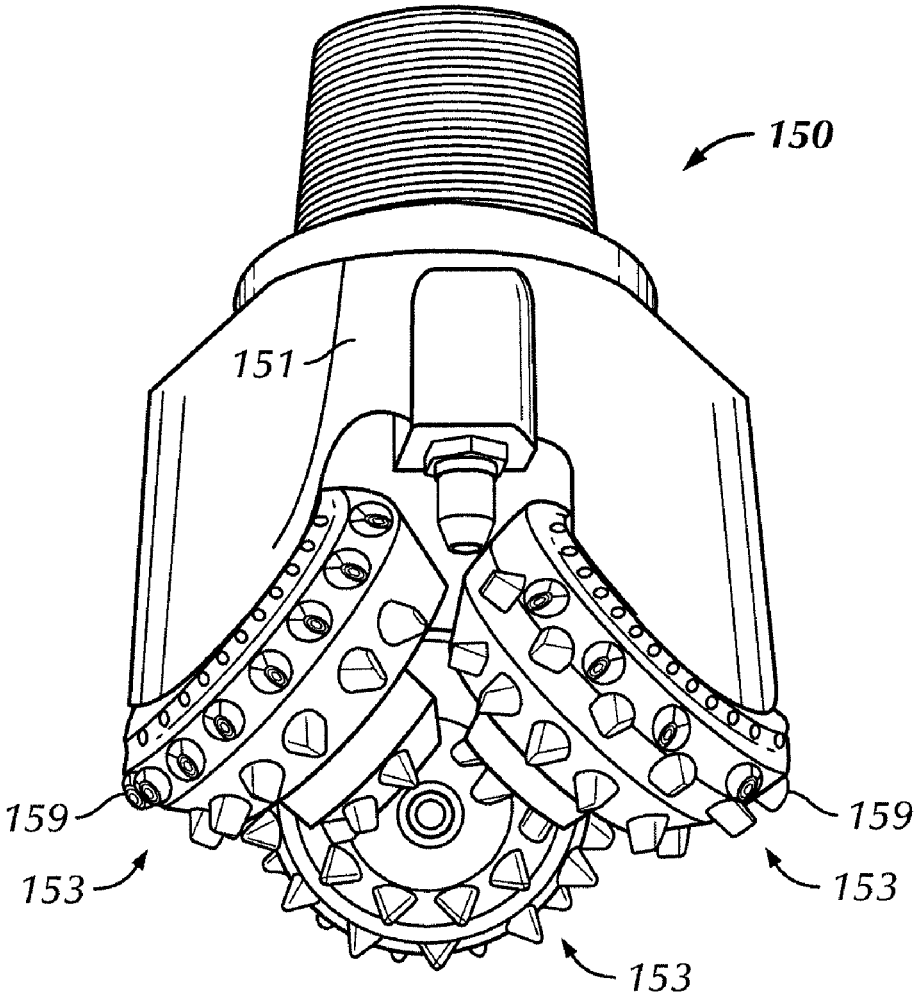
FIGS. 1A and 1B show a conventional roller cone drill bit and a conventional dome top cutting element, respectively.
Figure 1B:
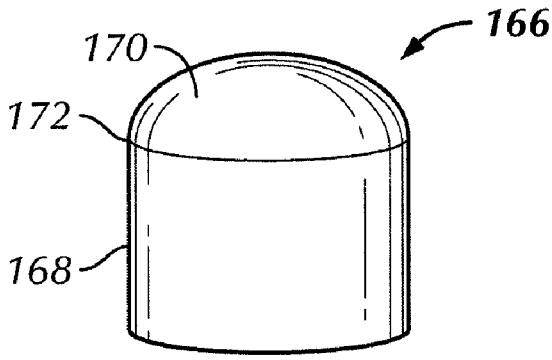
Figure 2:
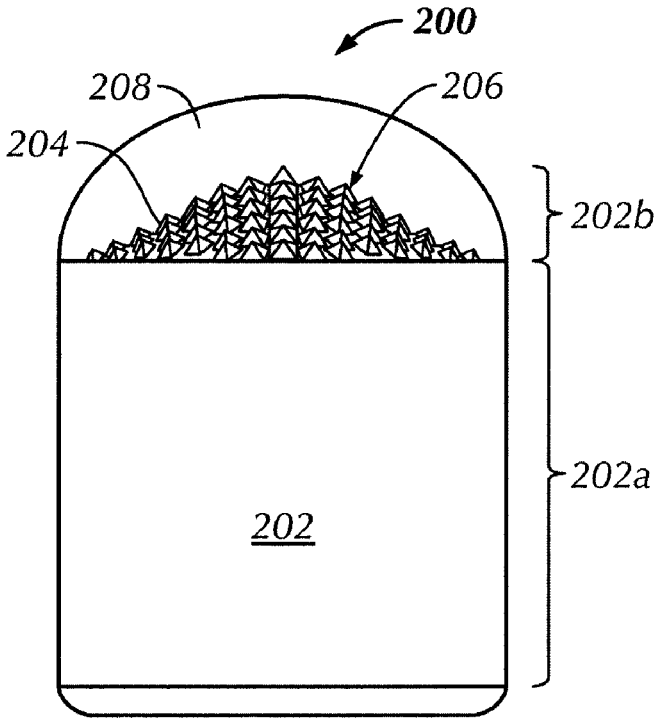
FIG. 2 shows a partial section view of a cutting element in accordance with one embodiment disclosed herein.

Initially referring to FIG. 2, a cutting element 200 in accordance with embodiments disclosed herein is shown. Generally, in accordance with the present application, cutting element 200 includes a substrate 202 and an ultrahard layer 208 formed on a top end of substrate 202. Substrate 202 includes a cylindrical grip portion 202*a* from which a convex cutting end 202*b* protrudes. While the embodiment shown in FIG. 2 shows a convex cutting end, typical of cutting elements used on a roller cone bit, embodiments disclosed herein may also be used on shear cutters, such as those used on a fixed cutter bit, which may typically have a generally non-curved cutting end, and would be planar without the surface features discussed below that create a non-planar interface.

An interface surface, as used herein, refers to the surface of substrate 202 that contacts ultrahard layer 208. At the interface surface between substrate 202 and ultrahard layer 208, substrate 202 includes a plurality of surface features 206 that create a non-uniform interface surface 204. In accordance with embodiments disclosed herein, the surface features 206 may be either projections, as shown in FIG. 2, or depressions. Additionally, a portion of the plurality of surface features 206 may intersect at least one other surface feature 206, thus forming an overlap, as will be described below in greater detail. Ultrahard layer 208 may be a polycrystalline diamond (PCD) or polycrystalline cubic boron nitride (PCBN) layer, and/or may include multiple layers. Ultrahard layer 208 is shown in section view so that the plurality of surface features 206 that create the non-uniform interface surface 204 may be seen.

The substrate of the cutting elements including the exemplary surface features described herein may be formed in a mold when the substrate is being cemented. For example, in one exemplary embodiment, tungsten carbide powder is provided in a mold with a metal binder. The powder is then pressed using a press surface having a design which is the complement of the desired interface surface design. The mold with powder and press are then heated, causing the binder to infiltrate and cement the tungsten carbide powder into a substrate body having the desired interface surface geometry. In an alternate embodiment, the substrate body may be formed using known methods and the desired interface surface may be machined on the interface surface using well known methods.

Figure 3:
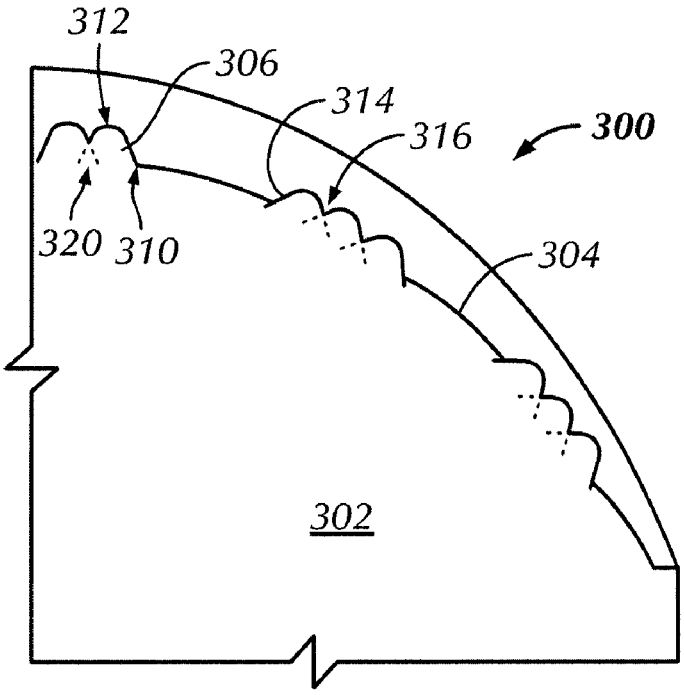
FIG. 3 shows a partial section view, of a cutting element in accordance with embodiments disclosed herein.

FIG. 3 shows a detailed cross-sectional schematic view of cutting element 300 surface features 306 that form non-uniform interface surface 304 in accordance with embodiments disclosed herein. In this embodiment, non-uniform interface surface 304 is formed by surface features 306 which may be projections. The interface or upper surface may have, for example, a generally flat or curved trend. Each projection 306 includes a base 310 (a geometric base) having the largest cross-sectional area of the projection and an extremity 312 disposed at a height furthest from base 310. At least one side surface 314 connects base 310 and extremity 312.

An intersection 316 of two side surfaces 314 of at least two projections 306 at a point between base 310 and extremity 312 causes projections 306 to share a portion of their total surface feature volumes. The portion of the total surface feature volume that projections 306 share is referred to herein as an overlapping surface feature volume 320. Overlapping surface feature volume 320 is disposed between intersection 316 and base 310, as shown. In certain embodiments, the two overlapping projections may share between about 0.25 and 50 percent of their total volumes (of each projection) at each overlap, and at least about 0.5 percent or at least about 1 percent to 20 percent in other embodiments. However, the present invention is not so limited. Rather, more or less overlap may also be within the scope of the present disclosure.

One of ordinary skill in the art will appreciate that, although three groupings of two and three intersecting projections 306 are shown in the embodiment of FIG. 3, any number of projections 306 on non-uniform interface surface 304 may intersect. Additionally, projections 306 (overlapping or not) may be staggered, random, aligned linearly, aligned concentrically, or otherwise symmetrically with respect to a perimeter of substrate 302. In certain embodiments, the projections 306 may be positioned in a combination of concentric, linear, random, and/or staggered arrangements.

In select embodiments, projections may be dome-shaped, pyramidal, polyhedral, conical, or any other shape. Accordingly, the extremity (furthest height from base) may be located on a curved portion, a point, a planar face, or a linear edge of the surface feature. Further, one of ordinary skill in the art will appreciate that a variety of interface surface patterns may be formed using projections of assorted shapes and/or sizes. For example, as shown in FIG. 3, three "groupings" of projections 306 along interface 304 are shown. The leftmost grouping of two projections 306 possess an extremity height that is greater than the other two groupings of projections 306. Such extremity height differential may or may not result in a difference in the overlapping volumes 320 and/or intersection height 316. For example, in one embodiment, intersecting projections 306 may possess intersection heights that vary with respect to the radial location on the interface. Specifically, one embodiment may provide for a first intersection height that is greater than a second intersection height for a projection radially outside such projection with first intersection height. The converse may also be true: a first intersection height may be less than a second intersection height on a projection radially outside such projection with first intersection height. Further, such difference in intersection heights may be alone or in conjunction with a difference in extremity height.

Figure 4:
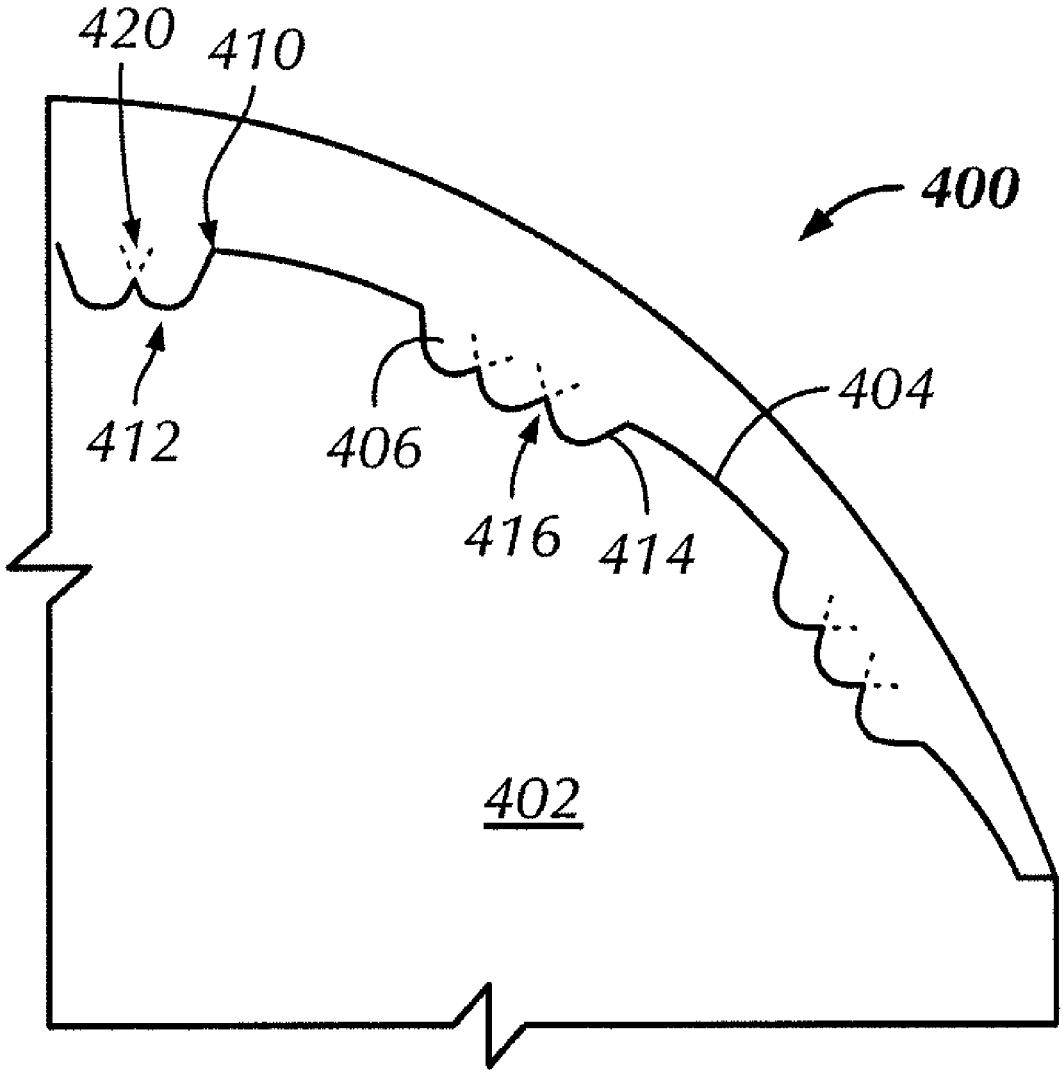
FIG. 4 shows a partial section view of a cutting element in accordance with embodiments disclosed herein.

FIG. 4 shows an alternate embodiment wherein surface features 406 that create non-uniform interface surface 404 on cutting element 400 are depressions. Each depression 406 includes a base 410 having the largest cross-sectional area of the depression and an extremity 412 disposed at a height furthest from base 410. At least one side surface 414 connects base 410 and extremity 412.

An intersection 416 of two side surfaces 414 of at least two depressions 406 at a height between base 410 and extremity 412 causes depressions 406 to share a portion of their total surface feature volumes. The portion of be total surface feature volume that depressions 406 share is referred to herein as an overlapping surface feature volume 420. Overlapping surface feature volume 420 is disposed between intersection 416 and base 410. In certain embodiments, the two overlapping depressions may share similar volumes of overlap as described above for two overlapping projections.

In select embodiments, the depressions may be dome-shaped, pyramidal, polyhedral, conical, or any other shape. Accordingly, the extremity may be located on a curved portion, a point, a planar face, or a linear edge of the surface feature. Further, one of ordinary skill in the art will appreciate that a variety of interface surface patterns may be formed using depressions of assorted shapes and/or sizes, similar to as discussed above with respect to projections.

One of ordinary skill in the art will appreciate that, although three groupings of two and three intersecting depressions 406 are shown in the embodiment of FIG. 4, any number of depressions 406 on non-uniform interface surface 404 may intersect. Depressions 406 may be staggered, aligned linearly, or aligned concentrically with respect to a perimeter of substrate 402. In select embodiments, depressions 406 may be positioned in a combination of concentric, linear, and/or staggered arrangements.

Referring now to FIG. 5A-D, an exemplary arrangement of four surface features 506 is shown. In this example, surface features 506 are projections, and four section views, A, B, C, and D, of surface features 506 are shown. The sections were obtained by taking slices of surface features 502 starting from extremity 512 (at A) and moving toward base 510 (at D).

In section A, extremities 512 and a top layer of surface features 506 are shown. In this embodiment, surface features 506 are pyramidal having four side surfaces 514 and an extremity 512 lying on a point. It can be seen from section A that the tops of surface features 506 are separate and do not intersect each other. For simplicity in illustrating the concept disclosed herein, surface features 506 have been shown as having the same height, shape, and size; however, one of ordinary skill in the art will appreciate that surface features may have varying heights, shapes, and/or sizes.

Section B shows in bold lines the next slice toward base 510 and shows the outline of section A using dashed lines. Section B shows surface features 506 still separate and not intersecting.

Section C shows the next slice toward base 510 in bold lines and sections A and B in dashed lines. It can be seen from section C that two of surface features 506 intersect at this height above their bases 510 (shown in section D). However, because base 510 of surface features 506 has not yet been reached, still further slices of surface features 506 must be taken to determine the extent of the overlap caused by the intersection.

Figure 5A:
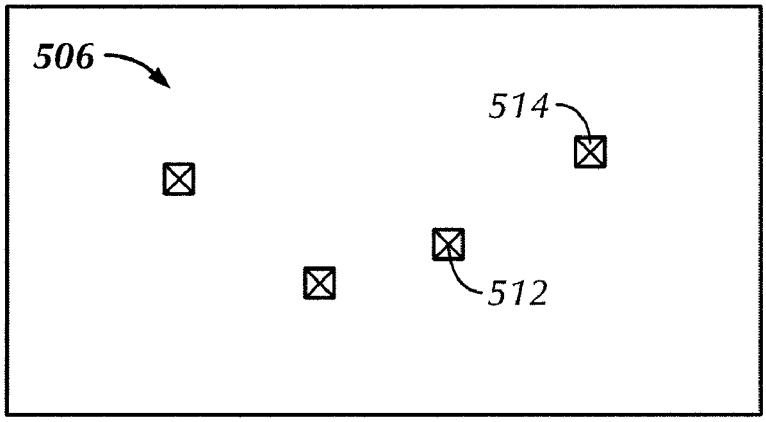
FIGS. 5A-E shows five plan views of an interface surface in accordance with embodiments disclosed herein.
Figure 5B:
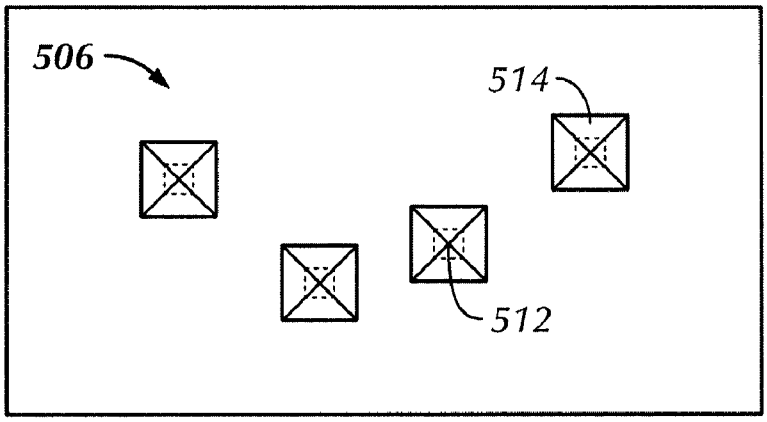
Figure 5C:
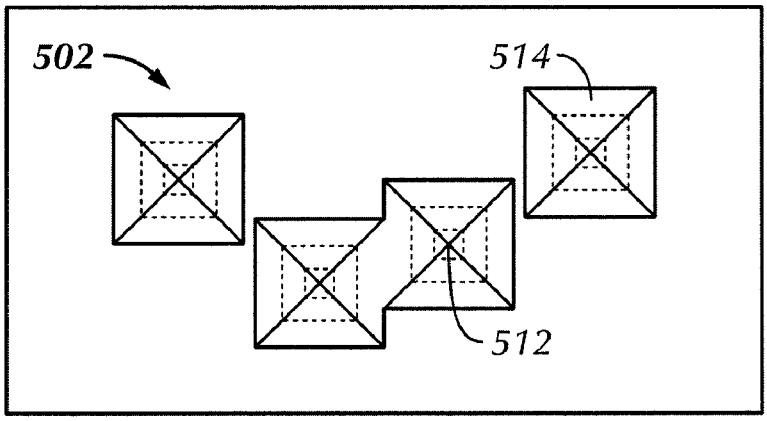
Figure 5D:
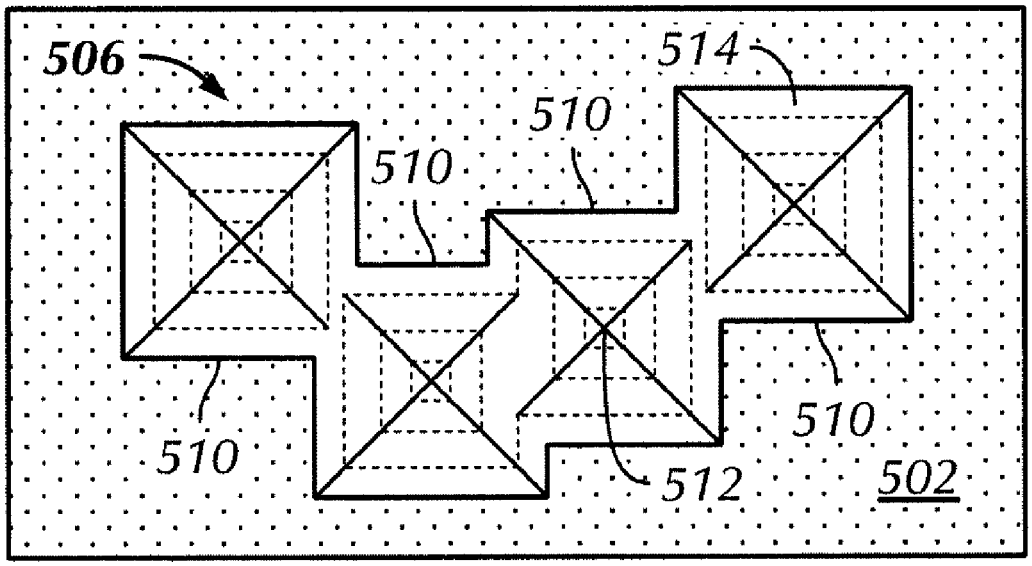
Figure 5E:
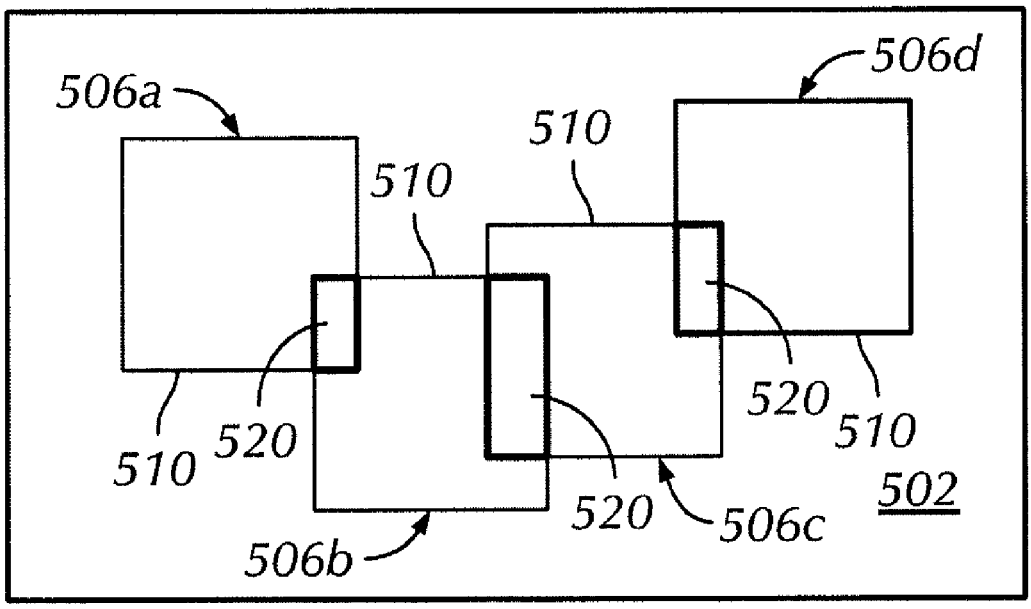

Section D reveals base 510 of surface features 506, and thus, also reveals the interior of substrate 502. In this section D, it is shown that all of the exemplary surface features 506 share at least a portion of their bases 510, and thus, share at least some overlapping volume. Referring now to FIG. 5E, a plan view of the overlapping areas of the bases 510 of exemplary surface features 506 shown in FIG. 5A-D is shown. The overlapping areas 520 created by the intersection of the surface features 506 at their bases 510 are shown with bolded lines.

One of ordinary skill in the art will appreciate that the same method as discussed above may be used to visualize the intersection and overlap of surface features that are depressions. Additionally, although only four surface features are shown in FIGS. 5A-E, any number of the plurality of surface features may intersect. Further, surface features 506 may be dome-shaped, pyramidal, polyhedral, conical, or any other shape as discussed previously. It is also noted that, as shown in FIGS. 5A-E, surface features 506 increase uniformly in size from section A to section D. However, in certain embodiments, a portion of surface features 506 may increase in size non-uniformly from extremity 512 to base 510. In yet another embodiment, a portion of surface features 506 may have a range of constant cross-sections. For all surface features (projections or depressions), the surface feature may have a smaller cross-sectional surface area at the extremity than at the base.

Also shown in FIG. 5E, surface feature 506*c* has the greatest amount of the perimeter of its base (as well as greater area of its base) encompassed by the overlap, as compared to surface features 506*a*, 506*b*, and 506*d*. The amount of base perimeter that may be "lost" to the overlap may broadly range from greater than 0% to less than 100%; however, in particular embodiments, it may range from 1 to 95%.

Figure 6:
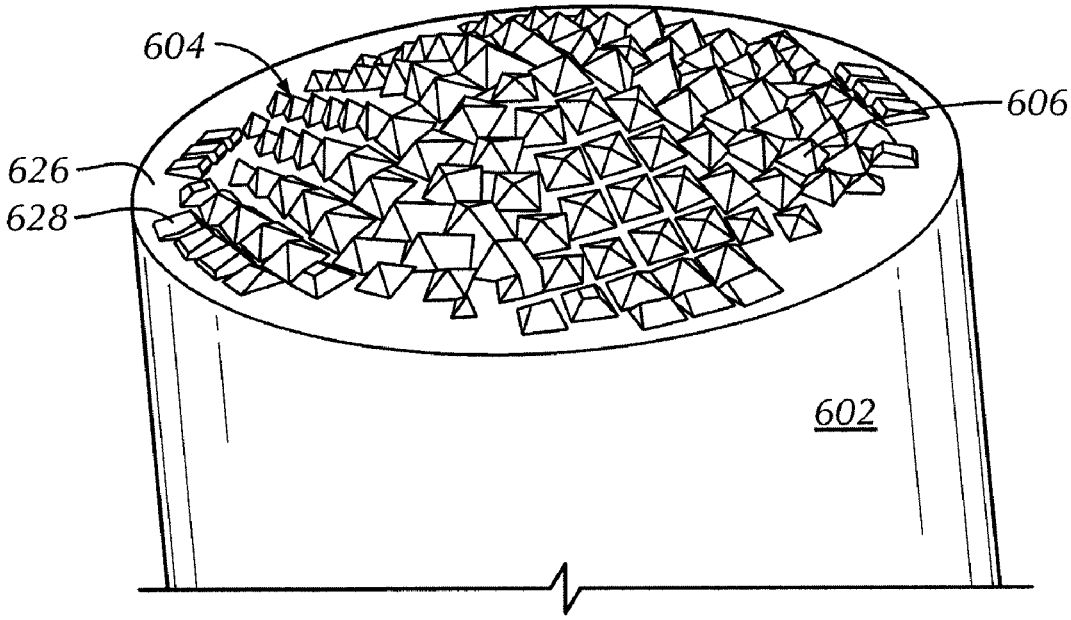
FIG. 6 shows a perspective view of an interface surface in accordance with embodiments disclosed herein.
Figure 7:
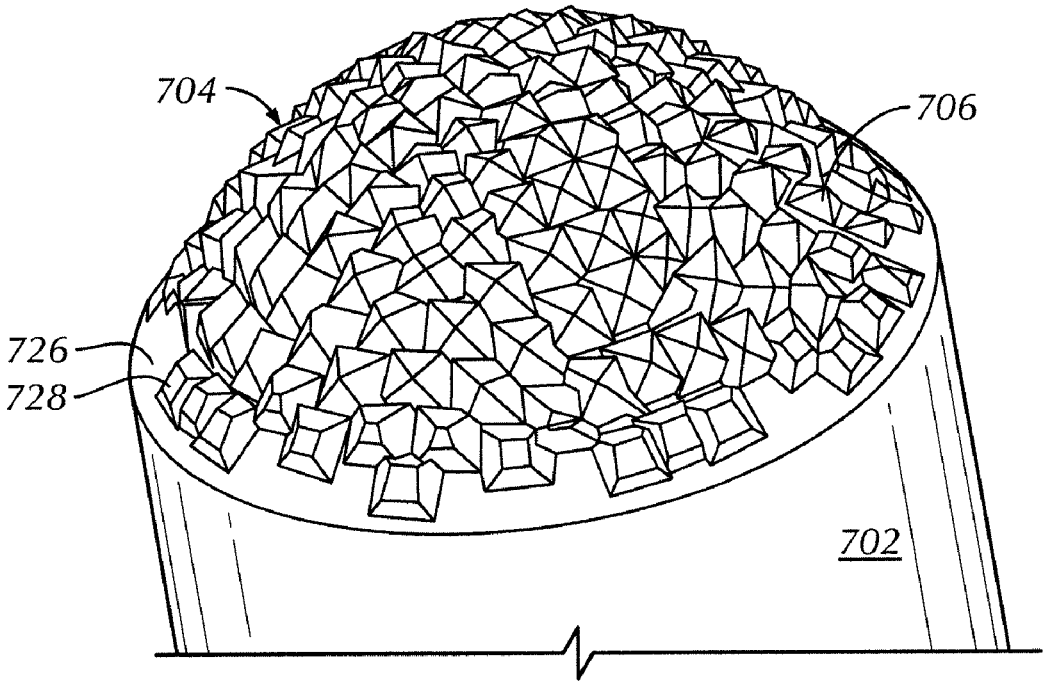
FIG. 7 shows a perspective view of an interface surface in accordance with embodiments disclosed herein.

Referring now to FIGS. 6 and 7, detailed views of exemplary non-uniform interface surfaces 604 and 704 made up of surface features 606, 706 in accordance with embodiments disclosed herein are shown. Surface features 606, 706 extend from a base to an extremity (or depress from a base to an extremity) such that a trend surface formed tangential to the bases of the plurality of surface features may be non-planar, i.e., the substrate may have a generally dome- or bell-shaped interface surface. The trend surface corresponding to non-uniform interface surface 604 shown in FIG. 6 may have a slight dome shape with a convex height/diameter ratio of approximately 0.15 while the constructed surface corresponding to non-uniform interface surface 704 shown in FIG. 7 may have a more pronounced dome shape with a convex height/diameter ratio of approximately 0.35. However, convex height/diameter ratio of less than 0.15 (including anything greater than 0), between 0.15 and 0.3, as well as greater than 0.3 (including, for example, up to 0.4, 0.5, or 0.6) are also contemplated. The convex height, as referred to herein, may begin where a transition from a cylindrical grip region to a non-uniform interface takes place and may extend to a greatest height of the cutting element. Thus, not accounting for surface features 606, 706, substrate 602, 702 may have a flat upper surface or may have an axisymmetric or asymmetric dome or bell shape or other non-planar trends. Additionally, in select embodiments, surface features 606, 706 may be either projections or depressions.

In select embodiments, it may be advantageous for a portion of surface features 606, 706 located near a perimeter 626, 726 (or radially outermost portion) of substrate 602, 702 to be shaped and/or spaced such that the extremity lies on an edge of a planar surface 628, 728, as shown. Planar surface 628, 728 may be substantially perpendicular to an axis normal to the base or may be disposed at an angle with respect to an axis normal to the base. Such angle may be selected based on the general trend of the interface surface and/or the diamond table disposed thereon. Additionally, in a particular embodiment having non-uniform surface features, the height differential between the extremity and the base of a surface feature may be greatest at the center of the cutting element and may be smallest for a surface feature near the outer diameter. Specifically, the distance between the base and the extremity of surface features 606, 706 near outer perimeter 626, 726 of substrate 602, 702 may be smaller than the distance between the base and the extremity of surface features 606, 706 near the central axis of the cutting element.

As shown in FIGS. 6-7, the plurality of surface features 606, 706 are formed from a plurality of projections. In particular, a portion of such projections are pyramidal in shape, with other projections being a truncated pyramid. In such an instance, a cross-section of projections perpendicular to an axis thereof is a polygon (specifically, a quadrilateral for the projections shown in FIGS. 6-8, but other polygon shapes are within the scope of the present disclosure). Further, while the embodiments show a substantially regular pyramid (i.e., a right pyramid formed from a regular polygon base), the present invention is not so limited. Rather, it is also within the scope of the present disclosure that pyramids (or truncated pyramids) formed from irregular bases and/or non-right pyramids may also be used. Further, in another embodiment, the cross-section of a surface feature perpendicular to an axis thereof may be an ellipse for other geometrical surface features.

Figure 8:
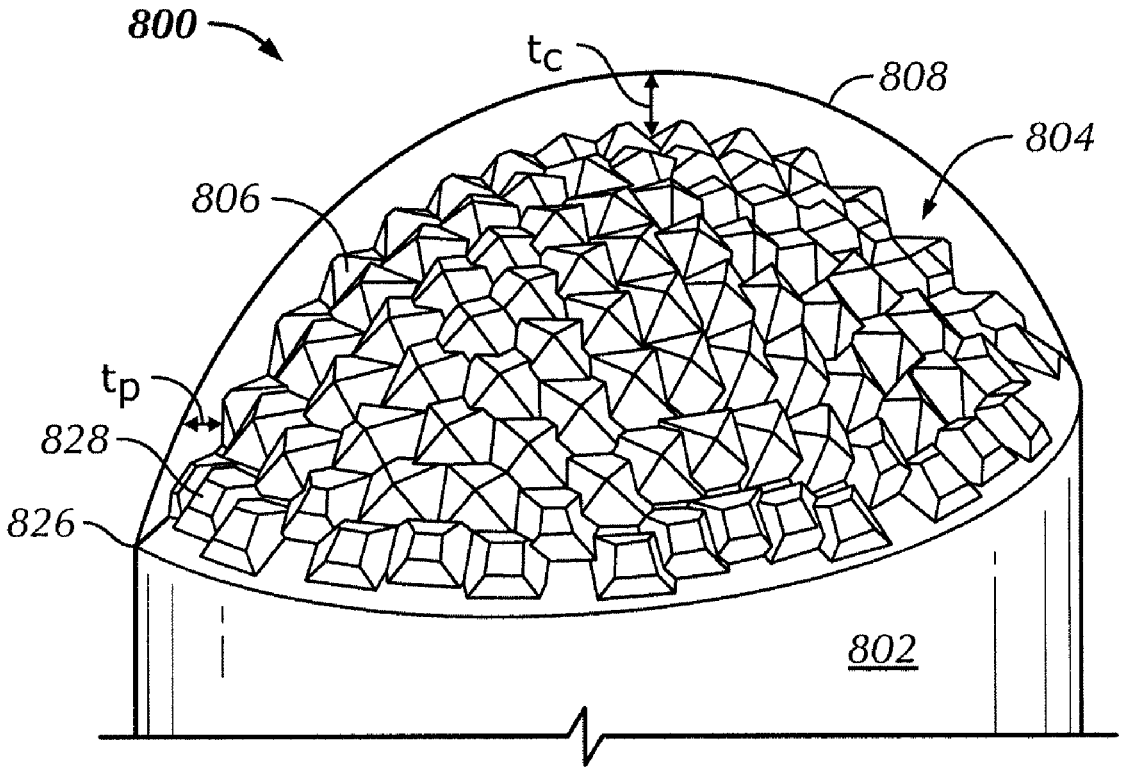
FIG. 8 shows a perspective view of a cutting element in accordance with embodiments disclosed herein.

Referring briefly to FIG. 8, similar to FIGS. 6 and 7, the non-uniform interface 804 is formed from pyramidal surface features (projections) 806, and truncated pyramidal surface features 806*a* having a planar extremity 828 adjacent a perimeter of the substrate 802. For embodiments of cutting element 800 having an ultrahard layer 808 with a domed upper surface disposed on substrate 802, the thickness of the ultrahard layer 808 near the perimeter of the substrate, $t_p$, is typically smaller than the thickness of the ultrahard layer at the center of the cutting element, $t_c$, as shown. The surface feature characteristics discussed above (shorter extremity height, planar extremity) may allow for portions of the ultrahard layer 808 to have an increased thickness at the perimeter of the substrate, $t_p$, which may minimize stress in the ultrahard layer.

Figure 9A:
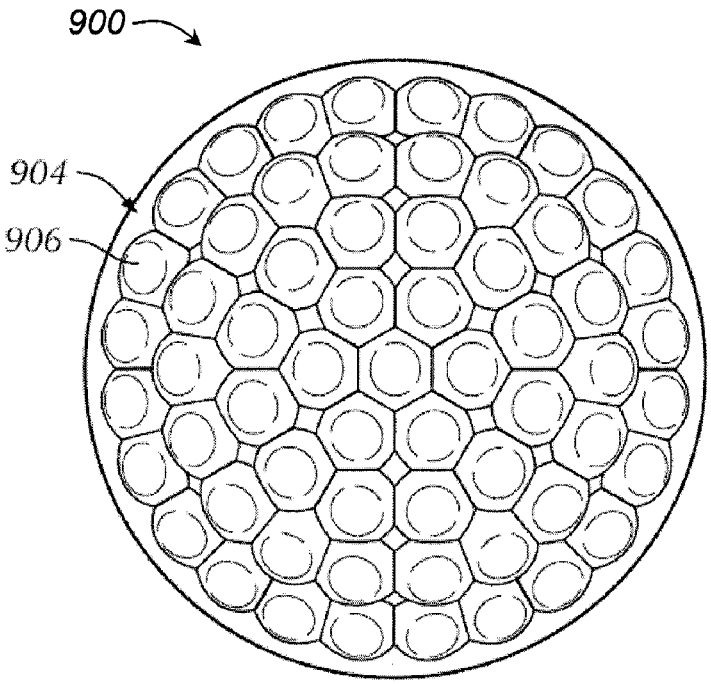
FIGS. 9A-B show a top and a perspective view of an interface surface in accordance with embodiments disclosed herein.
Figure 9B:
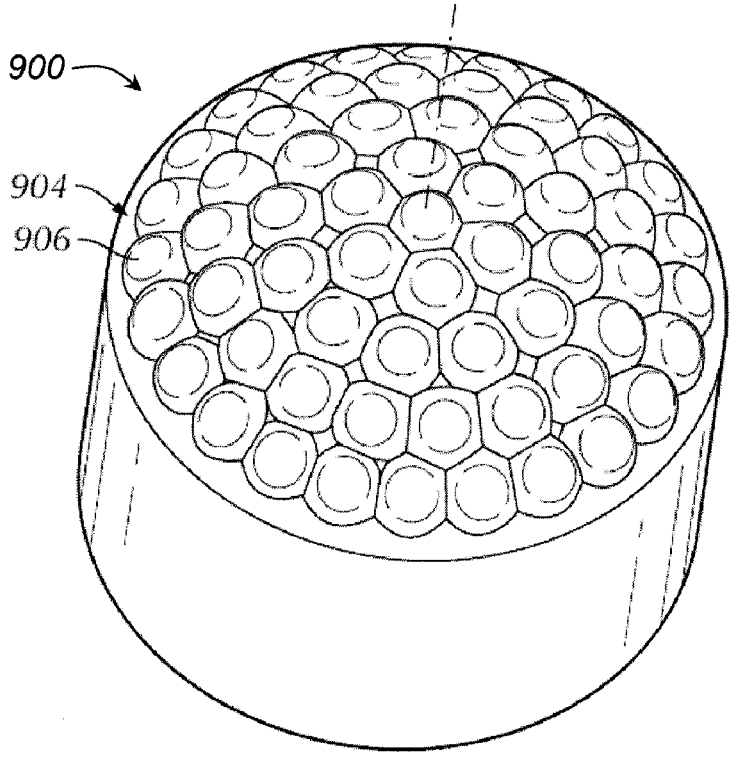

Referring now to FIGS. 9A-B, top and perspective views of one embodiment of an interface surface according to the present disclosure are respectively shown. As shown in FIGS. 9A-B, a non-uniform interface surface 904 is created by a plurality of projections 906. Projections 906 are generally-dome shaped, in that the side and top surfaces have curvature, but are not necessarily hemispherical. In such an instance, a cross-section of projections perpendicular to an axis thereof is an ellipse (specifically, a circle for the projections shown in FIGS. 9A-B, but other elliptical shapes are within the scope of the present disclosure). Further, it is also within the scope of the present disclosure that the projections may be truncated domes and/or truncated cones, which would also possess a cross-section of the projections perpendicular to an axis being is an ellipse.

Interface 904 includes one central projection 906 that is disposed along a longitudinal axis of the cutting element 900, and concentric rings of projections 906 surrounding such central projection. As shown in FIGS. 9A-B, each projection 906 lying on each concentric ring overlap two other projections 906 on the same ring, but the rings are also spaced such that projections from a ring also overlap projections from the adjacent ring(s) and/or central projection (depending on which ring the projection 906 lies). Specifically, as described above, the "overlap" between projections refers to the type of overlap discussed above. Further, in such an embodiment, the projections (and intersections) form an interface with radial symmetry. However, the present invention is not so limited. Rather, other types of symmetry such as bilateral symmetry are also within the scope of the present disclosure, as are asymmetric interfaces.

Figure 10A:
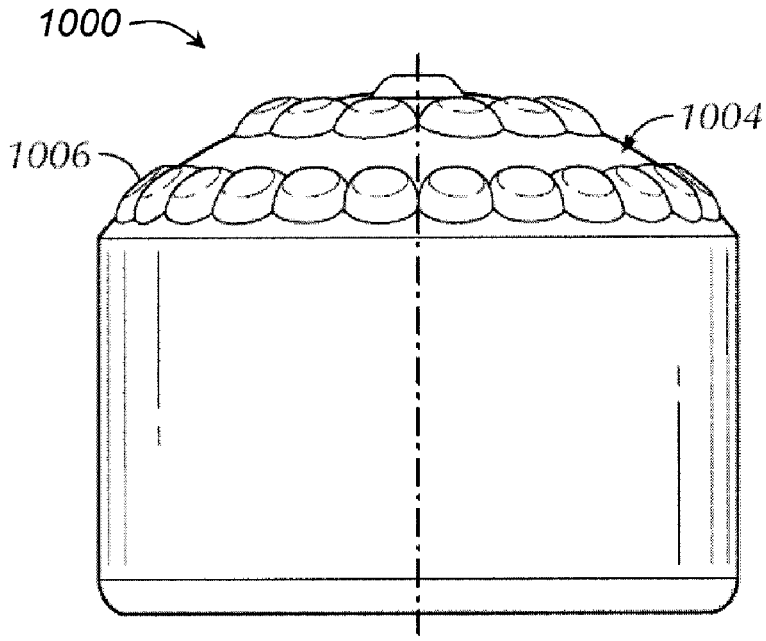
FIGS. 10A-B show a side and a top view of an interface surface in accordance with embodiments disclosed herein.
Figure 10B:
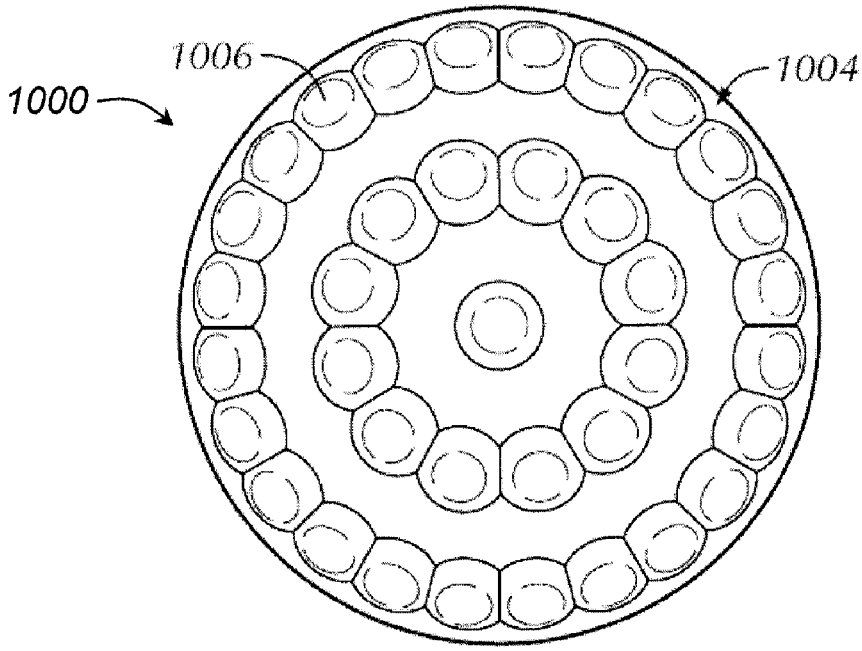

Referring now to FIGS. 10A-B, side and top views of one embodiment of an interface surface according to the present disclosure are respectively shown. As shown in FIGS. 10A-B, a non-uniform interface surface 1004 is created by a plurality of projections 1006. Like projections 906 shown in FIGS. 9A-B, projections 1006 are generally-dome shaped, in that the side and top surfaces are have curvature, but are not necessary hemispherical. Interface 1004 includes one central projection 1006 that is disposed along a longitudinal axis of the cutting element 1000, and concentric rings of projections 1006 surrounding such central projection. Like the projections shown in FIGS. 9A-B, each projection 1006 lying on each concentric ring overlaps two other projections 1006 on the same ring, but unlike the embodiment shown in FIGS. 9A-B, the rings are also spaced such that projections from a ring do not intersect projections from the adjacent ring(s) and/or central projection (depending on which ring the projection 1006 lies).

Figure 11A:
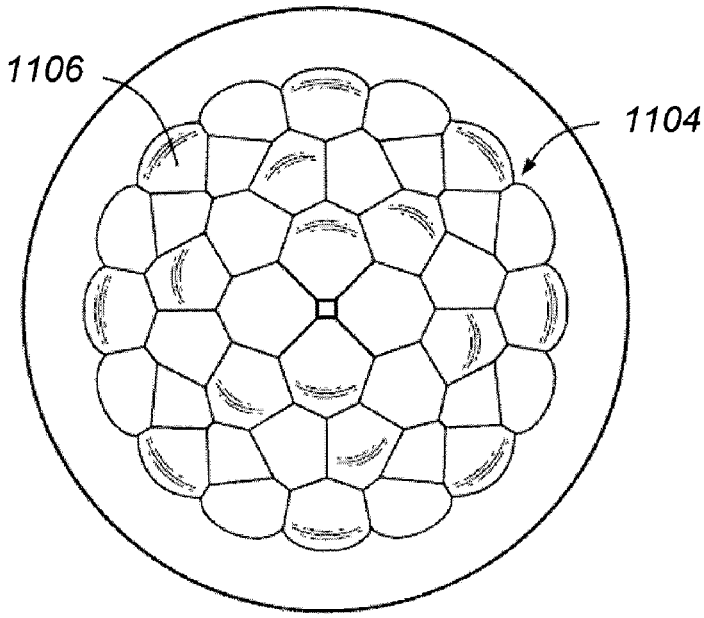
FIGS. 11A-B show a top and a side view of an interface surface in accordance with embodiments disclosed herein.
Figure 11B:
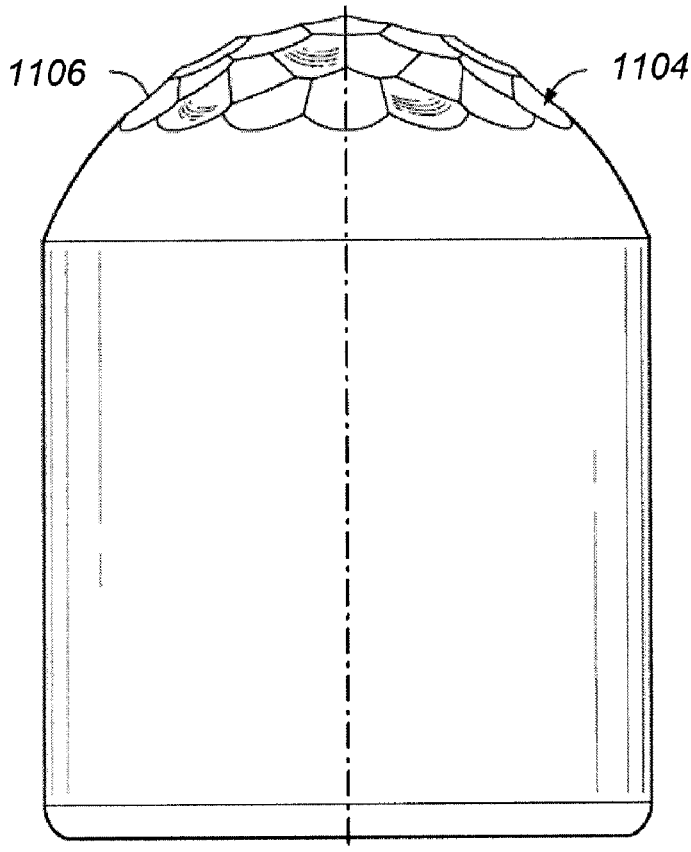

Referring now to FIGS. 11A-B, top and side views of one embodiment of an interface surface according to the present disclosure are respectively shown. As shown in FIGS. 11A-B, a non-uniform interface surface 1104 is created by a plurality of depressions 1106. Like projections 906 shown in FIGS. 9A-B, depressions 1106 are generally-dome shaped, in that the side and top surfaces are have curvature, but are not necessary hemispherical. Interface 1104 does not include a central depressions along a longitudinal axis of the cutting element (as shown in FIGS. 9A-B and 10A-B), but does possess radial symmetry.

Figure 12A:
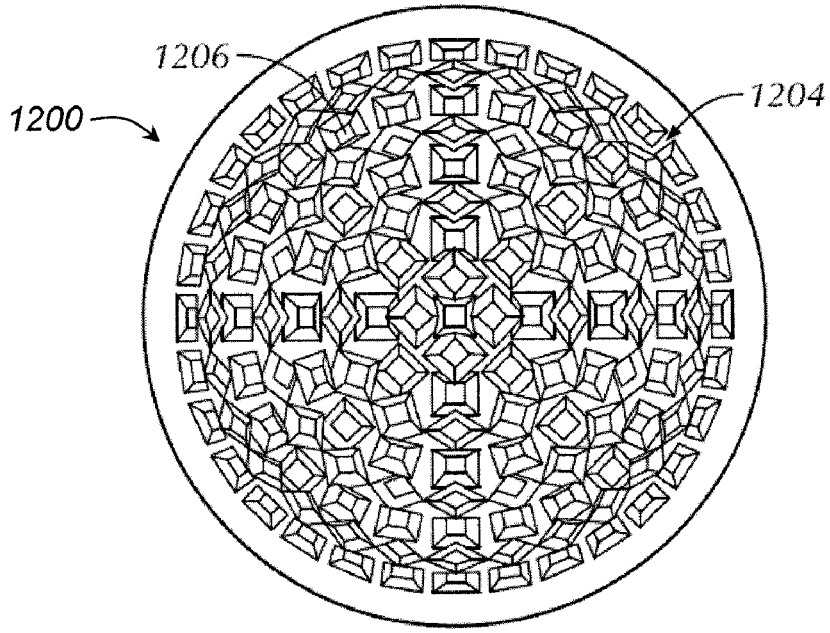
FIGS. 12A-E show a top, a perspective, a side, a sectional, and an enlarged sectional view of an interface surface in accordance with embodiments disclosed herein.
Figure 12B:
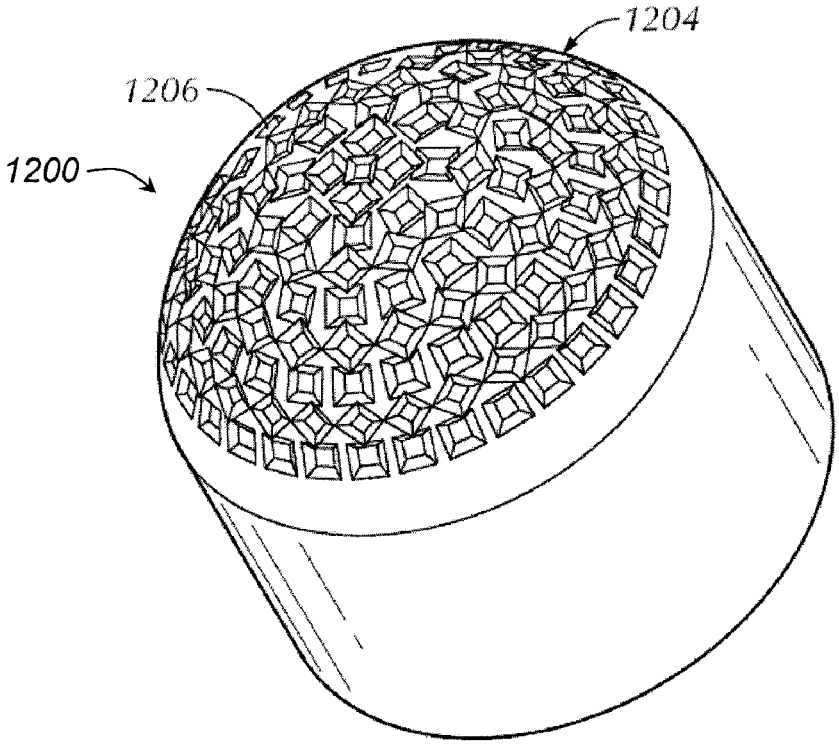
Figure 12C:
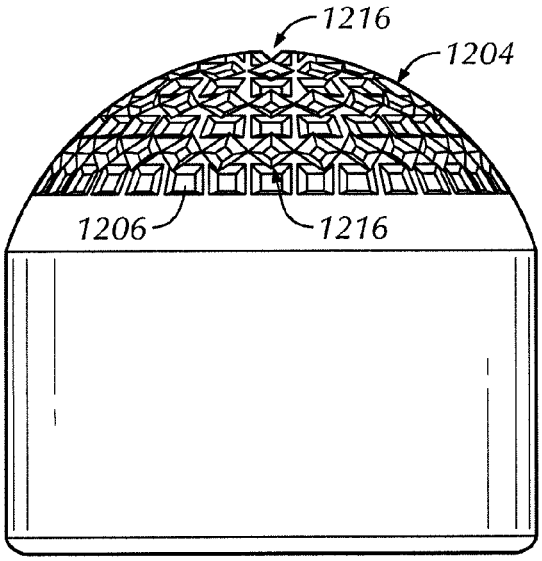
Figure 12D:
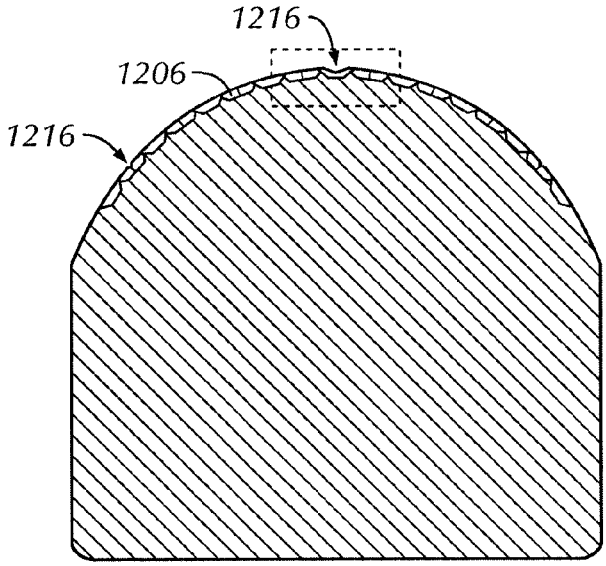
Figure 12E:
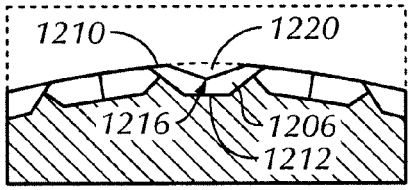

Referring now to FIGS. 12A-B, a top, a perspective, a side, a cross-sectional, and an enlarged cross-sectional view of one embodiment of an interface surface according to the present disclosure are respectively shown. As shown in FIGS. 12A-E, a non-uniform interface surface 1204 is created by a plurality of depressions 1206. Depressions 1206 are truncated pyramids. Interface 1204 includes one central depression 1206 that is disposed along a longitudinal axis of the cutting element 1200, and concentric rings of depressions 1206 surrounding such central depression. As shown in FIGS. 12A-E, some depressions 1206 lying on each concentric ring may intersect depressions 1206 on the same ring, but not all depressions 1206 on each concentric ring intersect a depression from the same ring. Further, rings are spaced such that depressions 1206 on a ring instead intersect depressions 1206 from the adjacent ring(s) and/or central depression 1206 (depending on which ring the depression 1206 lies). In the embodiment shown in FIGS. 12A-E, the depressions (and intersections) form an interface with radial symmetry (along four lines of symmetry). Further, for each pair of intersecting depressions, each depression possesses a different angle of orientation (with respect to a longitudinal axis of the cutting element). Additionally, it is also within the scope of the present disclosure that each depression need not intersect another depression, as is the case in the embodiment shown in FIGS. 12A-E. The intersection/overlapping between depressions 1206 may be more clearly seen in FIGS. 12D-E, which provide a cross-sectional view and an enlarged cross-sectional view of a portion of the cross-section. Specifically, as shown in FIGS. 12D-E, the intersection 1216 of pyramidal depression 1206 with its neighboring pyramidal depression (located on the same or different ring) is shown as the "notch" that interrupts base 1210. In this instance, the volume of overlap 1220 of the two depressions would be bounded by the surfaces of the "notch" and a surface that is tangential to the base(s) of the depressions, and is shown, for one of the pairs of overlapping depressions, by the cross-hatching. It is also clear that the intersection 1216 (point of the notch) is at a height intermediate the extremity 1212 and base 1210. Additionally, as shown in FIG. 12D, the amount of overlap between two depressions 1206 may vary between different pairs of depressions 1206. Specifically, the intersection 1216 (or notch) between two depressions 1216 proximate the longitudinal axis of the insert is deeper (with a greater overlapping volume 1220) than the intersection 1216 shown closer to the grip region of the insert. Thus, the extent of the overlap decreases from a center of the insert to the radially outermost portion of the insert (at the outer diameter). However, the present invention is not so limited. Rather, the extent of overlap may increase from a center of the insert to the radially outermost portion of the insert. Additionally, other variations between the surface features, such as depth of surface features, cross-sectional area of bases, etc., may also exist. Further, such variations may be progressive, step-wise, oscillating, or random.

Figure 13A:
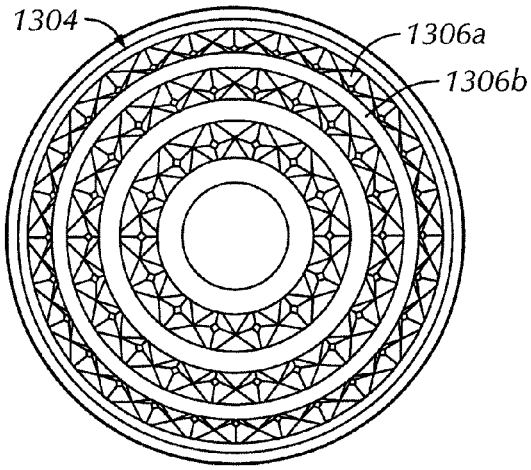
FIGS. 13A-D show a top, a perspective, a side, and a sectional view of an interface surface in accordance with embodiments disclosed herein.
Figure 13B:
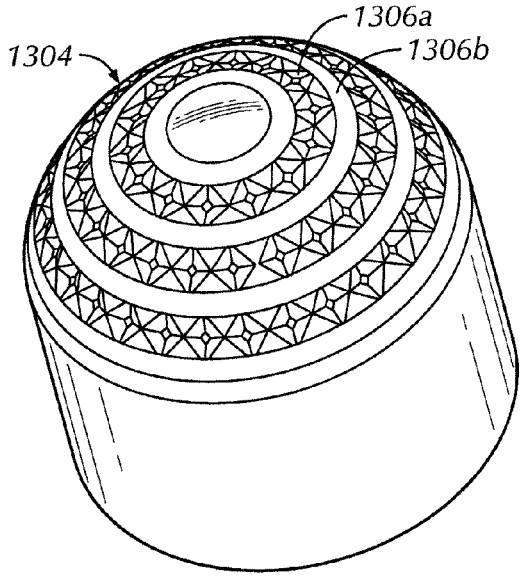
Figure 13C:
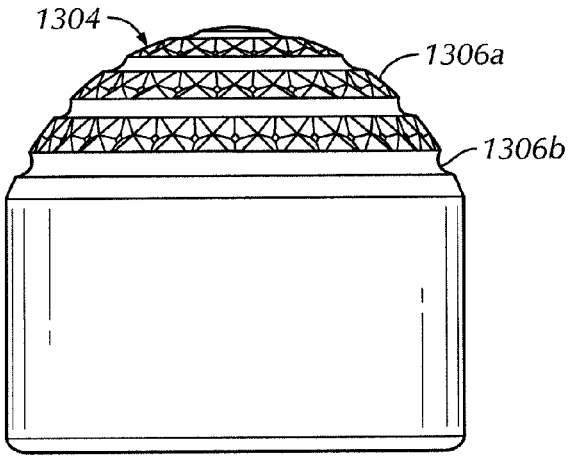
Figure 13D:
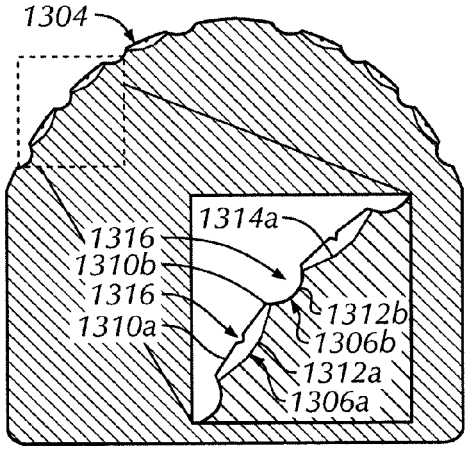

Referring now to FIGS. 13A-D, top, perspective, side, and cross-sectional views of one embodiment of an interface surface according to the present disclosure are respectively shown. As shown in FIGS. 13A-D, a non-uniform interface surface 1304 is created by a plurality of depressions 1306. Depressions 1306 include pyramidal depressions 1306*a* as well as concentric circular grooves 1306*b*. Between each pair of concentric circular grooves 1306*b* lays a concentric ring of intersecting pyramidal depressions 1306*a*. In addition to intersection between the neighboring pyramidal depressions 1306*a*, pyramidal depressions 1306*a* also intersect with the radially inner and outer concentric circular grooves 1306*b*. The intersection/overlapping between depressions 1306 may be more clearly seen in FIG. 13D, which provides a cross-sectional view and an enlarged view of a portion of the cross-section. Specifically, as shown in FIG. 13D, the intersection 1316 of pyramidal depression 1306*a* with its neighboring pyramidal depression (located on the same ring) is shown as the "notch" that interrupts base 1310*a*. In this instance, the volume of overlap of the two depressions would be bounded by the surfaces of the "notch" and a surface that is tangential to the base(s) of the depressions. It is also clear that the intersection 1316 (point of the notch) is at a height intermediate the extremity 1312 and base 1310. Additionally, there is also an intersection 1316/overlap between pyramidal depression 1306*a* and circular groove 1306*b*. The intersection 1316 between pyramidal depression 1306*a* and circular groove 1306*b* may be apparent by height differential between base 1310*a* and side surface 1314*a* at groove 1306*b*. Without such intersection, side surface 1314*a* would extend to base 1310*a*. Similarly, groove 1306*b* opens into pyramidal depression 1306*a* at a height intermediate its base 1310*b* and its extremity 1312*b*. The overlap volume may be similarly calculated.

Figure 14A:
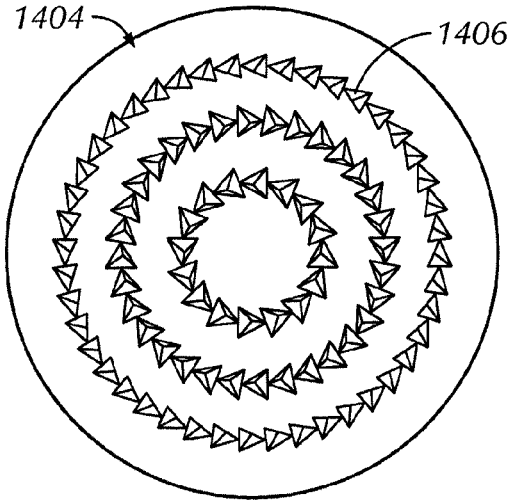
FIGS. 14A-C show a top a perspective, and a side view of an interface surface in accordance with embodiments disclosed herein.
Figure 14B:
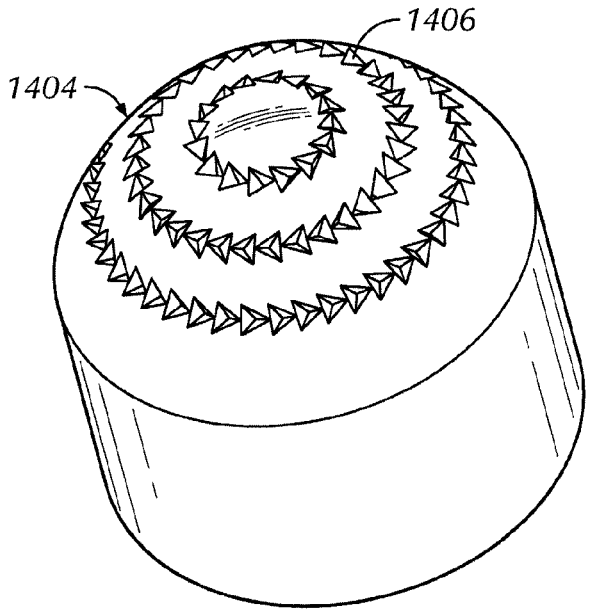
Figure 14C:
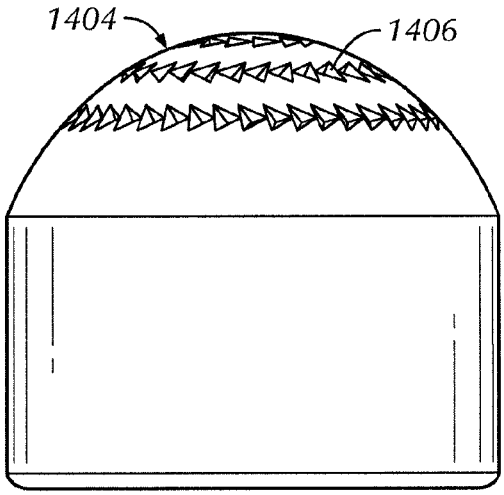

Referring now to FIGS. 14A-C, top, perspective, and side views of one embodiment of an interface surface according to the present disclosure are respectively shown. As shown in FIGS. 14A-C, a non-uniform interface surface 1404 is created by a plurality of depressions 1406. Depressions 1406 are pyramidal, but unlike those shown FIG. 13A-D, the cross-section of depressions 1406 perpendicular to a longitudinal axis of the depression is a triangle, not a quadrilateral. Interface 1404 includes concentric rings of depressions 1406. Each depression 1406 lying on each concentric ring overlaps two other depressions 1406 on the same ring, but the rings are also spaced such that depressions 1406 from a ring do not intersect depressions 1406 from the adjacent ring(s).

Figure 15:
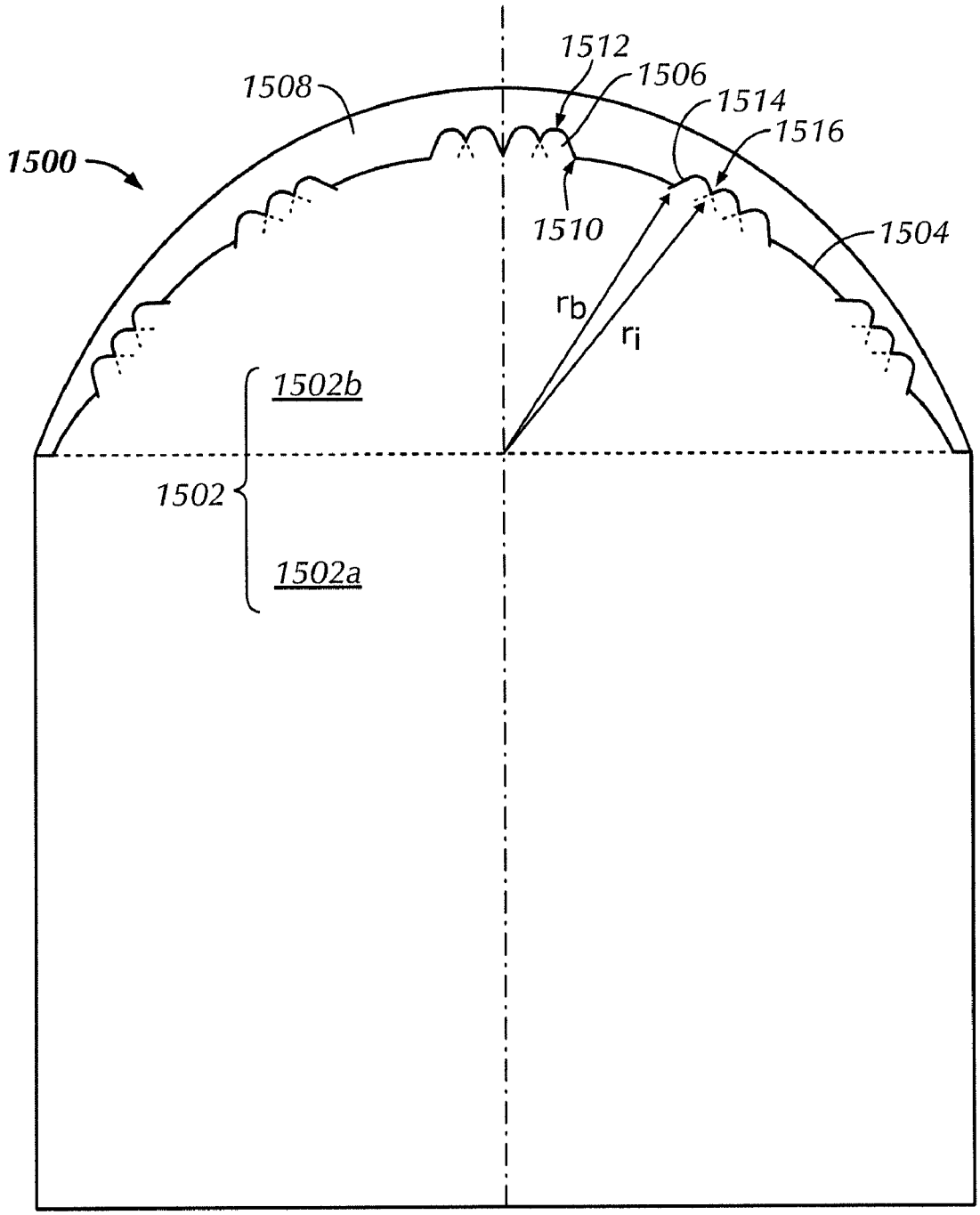
FIG. 15 shows a cross-sectional view of a cutting element in accordance with embodiments disclosed herein.

Referring now to FIG. 15, a cross-sectional view of a cutting element having a non-uniform interface in accordance with one embodiment of the present disclosure is shown. As shown in FIG. 15, a cutting element 1500 includes a substrate 1502 and an ultrahard layer 1508 formed on the top end of substrate 1502. Substrate 1502 includes a cylindrical grip portion 1502*a* from which a convex cutting end 1502*b* protrudes. At the interface surface between substrate 1502 and ultrahard layer 1508, substrate 1502 includes a plurality of surface features (projections, as shown in FIG. 15) 1506 that create a non-uniform interface surface 1504. Further, projections 1506 may intersect at least one other projection 1506, such that a normal distance or radius r, from the longitudinal axis at an upper end of the cylindrical grip region 1502*a* to the intersection 1516 of projection 1506 with the neighboring projection 1506 is not equal to a normal distance or radius $r_b$ to a base 1510 of projection 1506. For the projection 1506 illustrated in FIG. 15, the radius $r_i$ or length to the intersection 1516 is greater than the radius $r_b$ to the base 1510. Further, the non-equal radii (for the intersection and base) would also be present in a non-uniform interface that is formed with a plurality of depressions instead of projections. In a particular embodiment, the convex cutting end may be substantially hemispherical, and any projections may have a larger $r_i$ than $r_b$ while any depressions may have a smaller $r_i$ than $r_b$. Further, any of the above configurations, etc. may be used in such embodiments.

Figure 16:
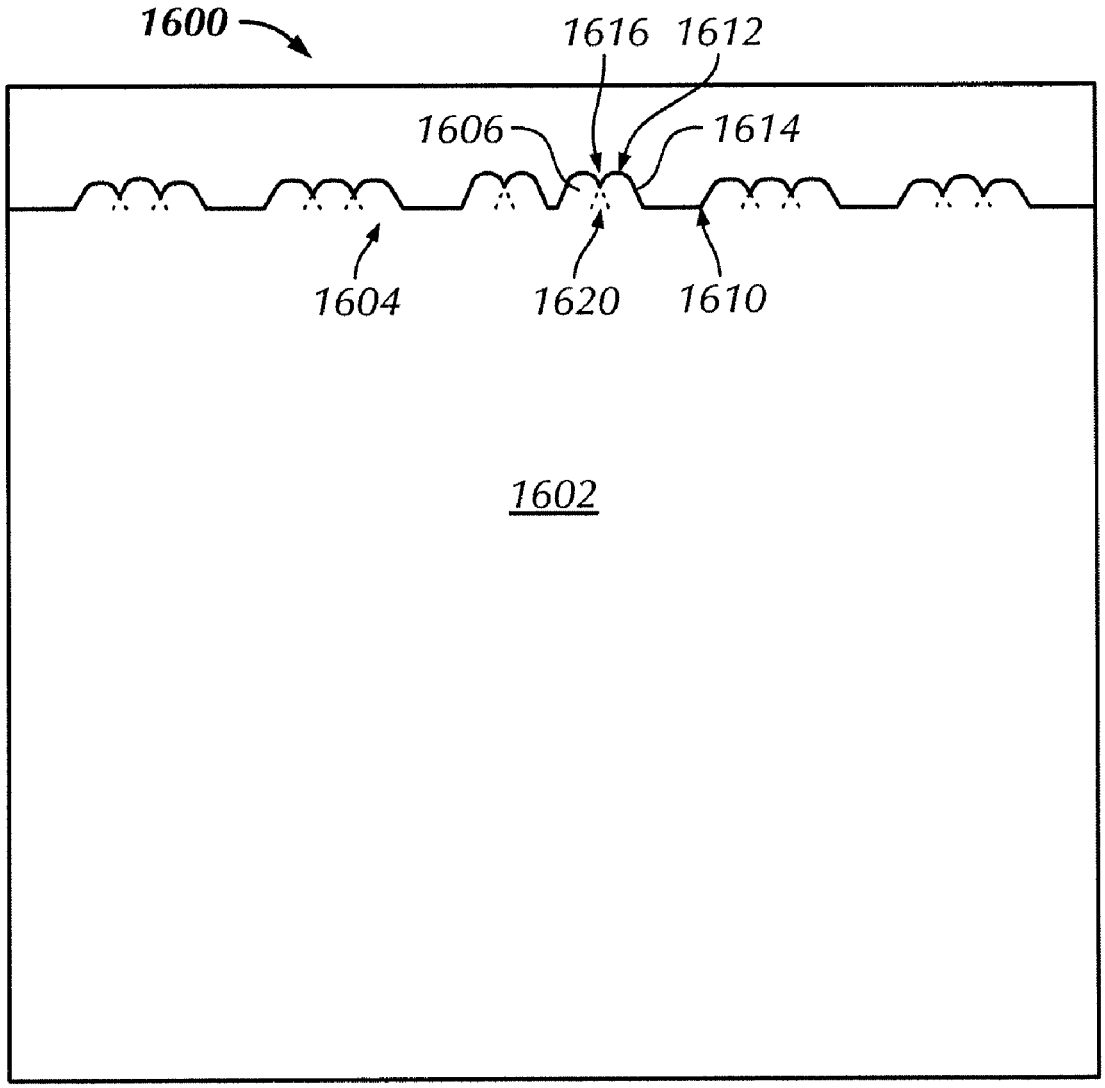
FIG. 16 shows a cross-sectional view of a cutting element in accordance with embodiments disclosed herein.

While the illustrated embodiments described above all show cutting elements having a non-planar diamond cutting end, the present invention is not so limited. For example, referring now to FIG. 16, a cutting element includes a substrate 1602 and an ultrahard layer 208 formed on a top end of substrate 1602 (not having a convex cutting end). At the interface surface between substrate 1602 and ultrahard layer 1608, substrate 1602 includes a plurality of surface features (projections) 1606 that create a non-uniform interface surface 1604. While projections are illustrated in FIG. 16, the non-uniform interface may also or alternatively be formed from depressions. Additionally, a portion of the plurality of surface features 1606 may intersect at least one other surface feature 1606, thus forming an overlap, as described above. An intersection 1616 of two side surfaces 1614 of at least two projections 1606 at a point between base 1610 and extremity 1612 causes projections 1606 to share a portion of their total surface feature volumes, referred to overlapping surface feature volume 1620. Overlapping surface feature volume 1620 is disposed between intersection 1616 and base 1610, as shown.

While embodiments described above show or refer to the substrate as being a cylindrical carbide body, the term substrate refers to any body or layer over which an ultrahard material layer is formed. For example, a "substrate" may be a transition layer formed over another substrate or may be the body on which an ultrahard transition layer is formed. A transition layer may be incorporated between any of the aforementioned exemplary embodiment cutting element substrates and their corresponding ultrahard layers. The transition layer typically has properties intermediate between those of the substrate and the ultrahard material layer. When a transition layer is used, the transition layer may be draped over the end surface such that it follows the contours defined on the surface of the transition layer interfacing with the ultrahard material layer. In an alternate embodiment, the transition layer may have a flat or non-planar surface interfacing with the ultrahard material layer. In yet a further alternate embodiment, instead of the interface surface geometry described herein being formed on the substrate, the interface surface geometry is formed on a surface of a transition layer which interfaces with the ultrahard material layer. Thus, it should be noted that any transition layer may be considered a substrate itself and possess a non-uniform interface surface on which an ultrahard material layer is disposed. As such, a substrate may be a transition layer for another substrate.

The embodiments disclosed herein may provide for one of the following advantages. The pattern of the interface surface created by surface features, as discussed above, may increase the surface area of the interface surface. In select embodiments, the surface area of the interface surface may be increased by 30 percent. An increase in surface area of the interface surface may extend the life of the cutting element by improving its impact strength.

Further, during drilling, cutting elements are subjected to impact forces that may damage or cause failure of the cutting element. In particular, material property differences between the ultrahard surface and the substrate and/or the transition layer are thought to introduce stress into the cutting element, which may cause spalling and delamination. Additionally, the impact forces may originate elastic waves in the cutting element that propagate therethrough. The elastic waves may reflect and interact with other elastic waves to cause destructive short term high tensile stresses which may lead to crack formation.

In certain embodiments disclosed herein, surface patterns may be designed having many small intersecting planes and surfaces which may diffract elastic waves released in the ultrahard layer during drilling operations by effectively breaking and/or scattering the fronts of the elastic waves. In diffracting the elastic waves, surface patterns in accordance with embodiments disclosed herein may dissipate the energy associated with elastic waves, and may decrease the likelihood of cutting element failure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A cutting element comprising:

a substrate having an interface surface;

an ultrahard material layer disposed on the interface surface; and the interface surface comprising a plurality of surface features, wherein at least one of the plurality of surface features intersects a neighboring surface feature at a height that is intermediate an extremity of the at least one of the plurality of surface features and a base of the at least one of b1 the plurality of surface features such that a radius from a longitudinal axis at an upper end of the substrate to the intersection is not equal to a radius to the base of the at least one of the plurality of surface features.

2. The cutting element of claim 1, wherein the interface surface is generally convex.

3. The cutting element of claim 1, wherein the extremity of the at least one of the plurality of surface features is curved, planar, linear, or a point.

4. The cutting element of claim 3, wherein the at least one of the plurality of surface features having planar extremity is disposed adjacent a perimeter of the substrate.

5. The cutting element of claim 4, wherein the planar extremity has a non-perpendicular angle with respect to an axis of the at least one of the plurality of surface features.

6. The cutting element of claim 3, wherein the planar extremity has a perpendicular angle with respect to an axis of the at least one of the plurality of surface features.

7. The cutting element of claim 3, wherein the planar extremity is a polygon or an ellipse.

8. The cutting element of claim 1, wherein a cross-section of the at least one of the plurality of surface features perpendicular to an axis thereof is a polygon or an ellipse.

9. The cutting element of claim 1, wherein a plurality of the surface features intersect a neighboring surface feature at a height that is intermediate the extremity of the plurality of surface features and the base of the plurality of surface features.

10. The cutting element of claim 9, wherein the plurality of intersecting surface features form a ring around a longitudinal axis of the cutting element.

11. The cutting element of claim 10, wherein the plurality of intersecting surface features form a plurality of concentric rings around the longitudinal axis of the cutting element.

12. The cutting element of claim 11, wherein at least one surface feature from a first of the plurality of concentric rings intersects with another surface feature from a second of the plurality of concentric rings.

13. The cutting element of claim 9, wherein the plurality of intersecting surface features form a pattern on the interface surface, the pattern being symmetric about a diameter of the substrate.

14. The cutting element of claim 9, wherein the plurality of intersecting surface features form a pattern on the interface surface, the pattern possessing radial symmetry.

15. The cutting element of claim 9, wherein at least one of the plurality of surface features intersects the neighboring surface feature at different height than at least one other of the plurality of surface features.

16. The cutting element of claim 9, wherein at least one of the plurality of surface features has extremity at different heights from the base than at least one other of the plurality of surface features.

17. The cuttings element of claim 1, wherein the at least one of the plurality of surface features is a pyramid, cone, dome, truncated cone, truncated dome, or truncated pyramid.

18. The cutting element of claim 1, wherein at least one of the surface features is a circular groove or projection about a longitudinal axis of the cutting element.

19. A cutting element comprising:

a substrate having a cylindrical grip region, a substantially convex cutting end extending from the cylindrical grip region, and a longitudinal axis of the cylindrical grip region extending through the cylindrical grip region and the substantially convex cutting end; and an ultrahard material layer disposed on the substantially convex cutting end of the substrate;

wherein the surface of the substantially convex cutting end of the substrate comprises a plurality of surface features, wherein at least one of the plurality of surface features intersects a neighboring surface feature such that a radius from the longitudinal axis at an upper end of the cylindrical grip region to the intersection of the at least one of the plurality of surface features with the neighboring surface feature is not equal to a radius to a base of the at least one of the plurality of surface features, and wherein an extremity of the at least one of the plurality of surface features is at a substantially same height as an extremity of the neighboring surface feature.

20. The cutting element of claim 19, wherein the substantially convex cutting end is substantially hemispherical.

21. The cutting element of claim 20, wherein the at least one of the plurality of surface features is a projection.

22. The cutting element of claim 21, wherein the radius to the intersection is greater than the radius to the base.

23. The cutting element of claim 20, wherein the at least one of the plurality of surface features is a depression.

24. The cutting element of claim 19, wherein the radius to the intersection is less than the radius to the base.

25. The cutting element of claim 19, wherein a cross-section of the at least one of the plurality of surface features perpendicular to an axis thereof is a polygon or an ellipse.

26. The cutting element of claim 19, wherein a plurality of the surface features intersect a neighboring surface feature such that the radii to the intersections are not equal to the radii to the base.

27. The cutting element of claim 26, wherein the plurality of intersecting surface features form a ring around a longitudinal axis of the cutting element.

28. The cutting element of claim 27, wherein the plurality of intersecting surface features form a plurality of concentric rings around the longitudinal axis of the cutting element.

29. The cutting element of claim 28, wherein at least one surface feature from a first of the plurality of concentric rings intersects with another surface feature from a second of the plurality of concentric rings.

30. The cutting element of claim 26, wherein the plurality of intersecting surface features form a pattern on the interface surface, the pattern possessing radial symmetry.

31. The cuttings element of claim 19, wherein the at least one of the plurality of surface features is a pyramid, cone, dome, truncated cone, truncated dome, or truncated pyramid.

32. The cutting element of claim 19, wherein at least one of the surface features is a circular groove or projection about a longitudinal axis of the cutting element.

* * * * *